United States Patent [19]

Whitman

[11] 3,943,503

[45] Mar. 9, 1976

[54] ELECTRONIC INTRUDER ALARM APPARATUS

[75] Inventor: Jeremy Hugh Whitman, Leatherhead, England

[73] Assignee: Unwin Electronics Ltd., West Molesey, England

[22] Filed: Nov. 11, 1974

[21] Appl. No.: 522,579

[30] Foreign Application Priority Data

Nov. 13, 1973 United Kingdom ..... 52674/73

[52] U.S. Cl. ..... 340/258 B; 343/7.7

[51] Int. Cl.[2] ..... G08B 13/18

[58] Field of Search ..... 340/258 B, 258 A; 343/7.7

[56] References Cited

UNITED STATES PATENTS

| | | | |
|---|---|---|---|
| 3,603,957 | 9/1971 | Merchant | 340/258 B |
| 3,745,550 | 7/1973 | Anthony et al. | 340/258 B |
| 3,828,336 | 8/1974 | Massa | 340/258 A |

*Primary Examiner*—Glen R. Swann, III

*Attorney, Agent, or Firm*—Lawrence E. Laubscher

[57] ABSTRACT

A radio-frequency source irradiates a space within which an intruder is to be detected, this space being illuminated by fluorescent tubes. Successive peak levels in the returned signals are compared and a fall in the peak amplitude results in a comparator, arranged to compare the peak amplitude with that of a preceding peak, failing to yield a reset signal to a timer circuit. After a time interval just greater than the periodicity of the a.c. supply to the fluorescent tubes the time yields an alarm control signal. If the peak value recovers during this interval the timer is reset and no alarm control signal is generated. The alarm control signals are applied to an integrator yielding alarm signals in response to predetermined repetition of the alarm control signals. The alarm signal is delayed and used to reset the integrator, as well as initiating an alarm condition.

10 Claims, 2 Drawing Figures

ELECTRONIC INTRUDER ALARM APPARATUS

BACKGROUND OF THE INVENTION

The present invention relates to radio intruder alarm systems and is especially, though not exclusively, applicable to a microwave radio intruder alarm system.

A radio intruder alarm system of known kind includes a radio-frequency source for irradiating with radio-frequency radiation a space within which an intruder is to be detected. The known system also includes a radio detector responsive to said radiation returned towards said source from objects within said space or from the boundaries thereof, to yield detector signals representative of the amount of said returned radiation. The detector signals are applied to signal processing circuits responsive to said detector signals to yield an alarm signal in response to predetermined fluctuations in the amount of returned radiation.

An alarm system of the known kind described above may provide a false alarm in response to returned radiation reflected fluctuatingly from the ionized gas within illuminated fluorescent lighting tubes. Such spurious signals may be processed by the signal processing circuits as being fluctuations resulting from the presence of an intruder within the space to be protected.

SUMMARY OF THE INVENTION

The invention has the object of providing a radio intruder alarm system which shall be immune to radiation returned by reflection from illuminated fluroescent tubes.

It is a further object of the invention to provide a radio intruder alarm system in which a signal peak comparator means yields a resetting signal to reset a timer whenever the peak amplitude of a radio return signal is not substantially less than that of a preceding peak signal, said timer being so arranged that when the timer is repeatedly reset, no alarm is given, but if the reset signal is delayed for a period somewhat exceeding the periodicity of an a.c. supply used to energize fluroescent lighting tubes within the protected area, an alarm signal will be developed.

Preferred features and advantages of an embodiment of radio intruder alarm system in accordance with the invention will become apparent from the following description.

DESCRIPTION OF THE PREFERRED EMBODIMENT

Figure 1:
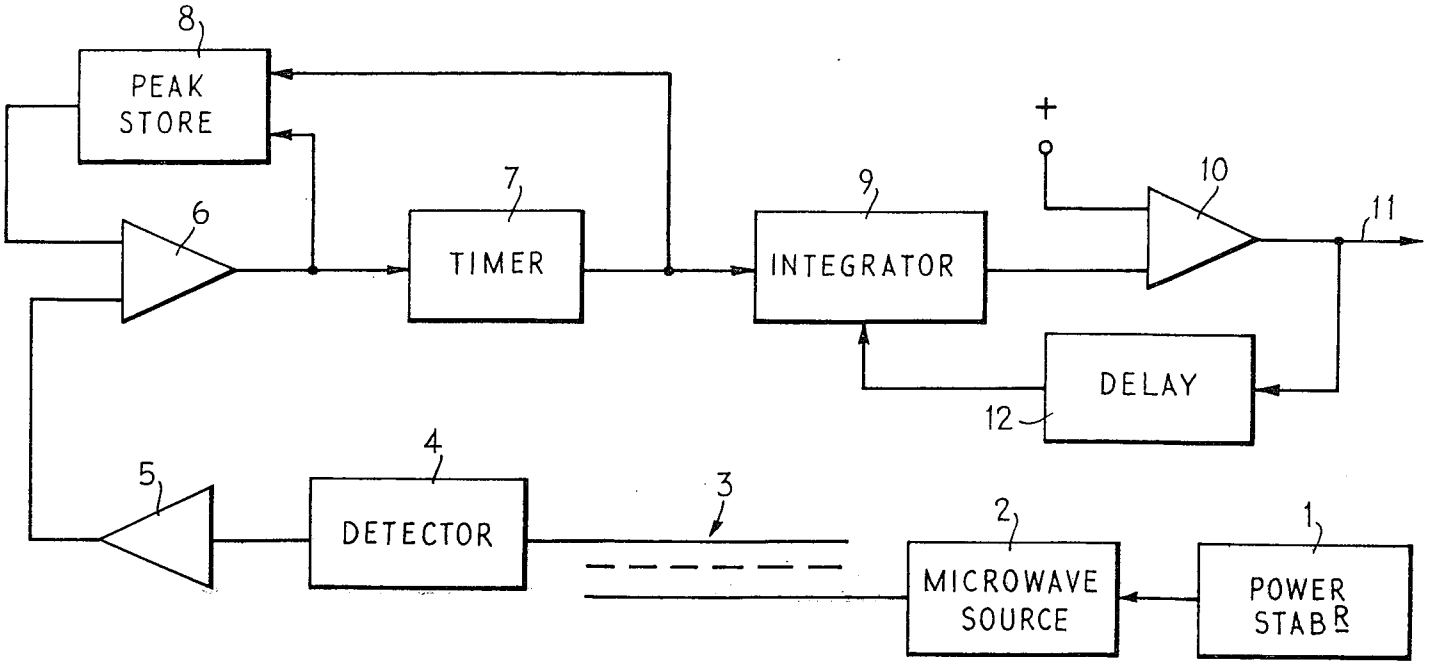
FIG. 1 is a block diagram of a microwave intruder alarm system.

Referring now to FIG. 1, a stabilised power supply 1 drives a microwave oscillator 2, conveniently including a Gunn diode, which feeds an aerial 3. The aerial has a directive radiation pattern for irradiating a space to be protected, such as a warehouse, art gallery or the like. The aerial also receives microwave returns from the region which are directed to a microwave detector 4. The demodulated output of the detector 4 is applied to an amplifier 5, and hence to comparator 6 to compare the level of the input signal with a reference voltage. The comparator 6 provides an output when the input from the detector 4 exceeds the reference voltage, this output being arranged to reset a timer 7. The timer provides an output after a time period of typically 22 ms, during which the input from detector 4 is less than the reference level. A decaying peak level store 8, which may typically comprise a capacitor with a shunt resistor, sets the voltage reference level applied to the comparator 6. The output of the comparator is arranged to charge the decay store; an output from the timer completely discharges the capacitor.

In the absence of an intruder, the output of amplifier 5 has a constant voltage level due to returns from the oscillator 2 with a superimposed periodic voltage due to the fluorescent tubes. As the output of amplifier 5 reaches a voltage peak, the capacitor of decay store 8 is charged to a level indicative of the peak, and subsequently as the voltage output of amplifier 5 falls following the peak, the output of comparator 6 ceases, thus starting the timer 7. As long as the next peak of the output of amplifier 5 occurs within a period substantially equal to one half of the periodicity of the local a.c. supply, that is, 22 milliseconds for a 50 Hz supply, an output from the timer is inhibited. During the period of 22 ms, the voltage level in store 8 decays slightly, so that if the next peak voltage level at the output of amplifier 5 is substantially similar to the previous peak level, the comparator will provide an output inhibiting timer 7.

If, however, an intruder is present in the region, the microwave returns from oscillator 2 will vary with time, and the values of successive periodic peaks in the output of amplifier 5 will be different. Thus a second peak level applied to the comparator 6 may be less than a first peak level such that the comparator 6 provides no output and the timer 7 provides an output signal to an integrator 9. If the second peak level is greater than the first peak level, the timer output is inhibited but since the capacitor of store 8 is charged to a high level, a third peak level is likely to be less than the second level and when this occurs the timer 7 provides an output signal.

An output signal from the timer 7 is arranged to discharge the capacitor of peak level store 8 such that the capacitor is charged to a level indicative of a next peak level at the output of amplifier 5.

The integrator 9 integrates the timer output over several seconds, the output of the integrator being compared with an alarm threshold level in a comparator 10. An output from the comparator is arranged to trigger an alarm output device as indicated at 11, which may comprise a relay arranged to control an alarm bell. The output of comparator 10 is also fed via a delay device 12 providing a delay of, for example, 1 second to reset the integrator 9 rapidly and thus reduce the time taken for the system to become operational again.

Figure 2:
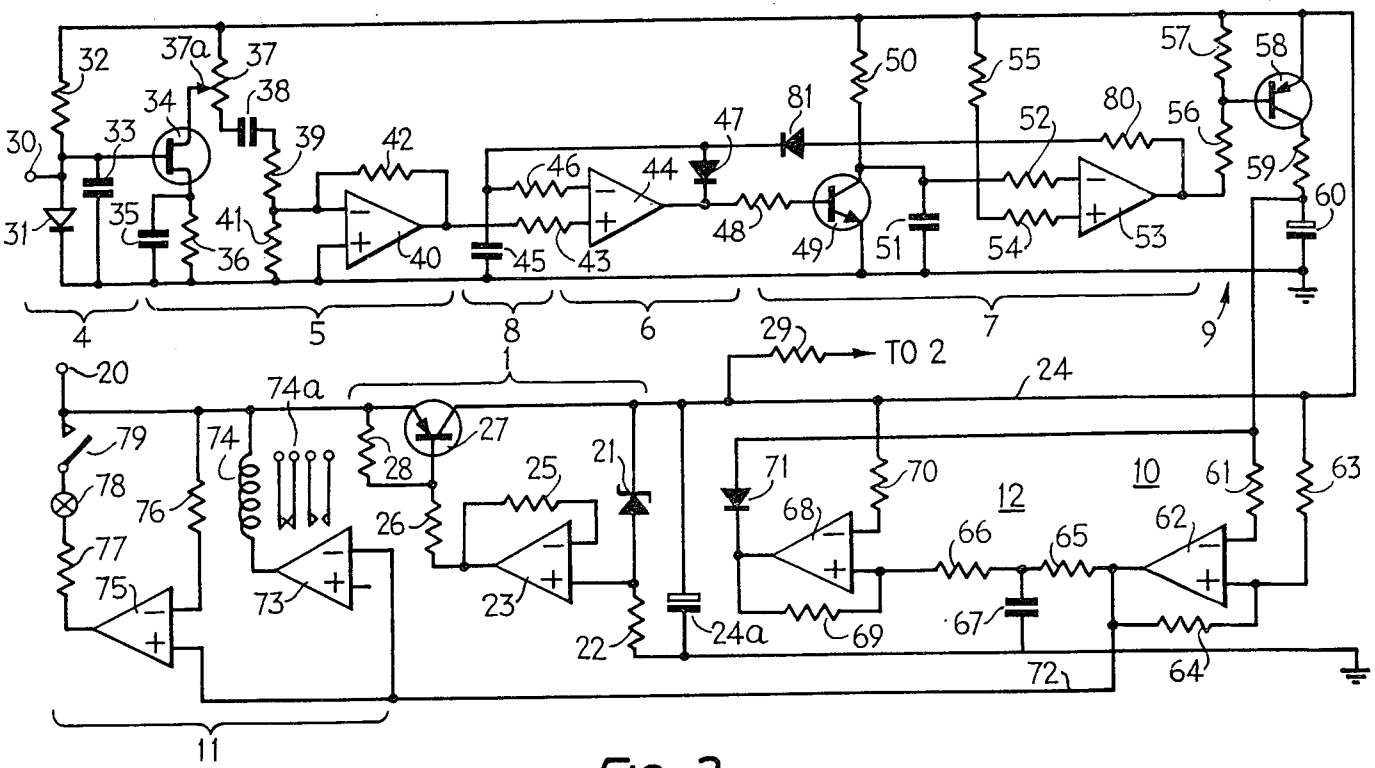
FIG. 2 is a schematic circuit diagram of the intruder alarm system.

In the more detailed circuit arrangement of an intruder alarm apparatus in accordance with the invention which is shown in FIG. 2, a supply terminal 20 is intended to be connected to the positive pole of an unstabilised d.c. supply (not shown) of which the negative pole is earthed. The unstabilised supply voltage thus received is stabilised by a voltage stabiliser circuit 1. A voltage divider consisting of the series combination of a Zener diode 21 and a resistor 22 is used to apply to the non-inverting input of an amplifier 23 a signal representative of any variation of the voltage on a stabilised positive supply line 24 from a predetermined value. Amplifier 23 is provided with negative feedback by way of a resistor 25 and its output signal is applied by way of a resistor 26 to the base of a stabilising transistor 27. Transistor 27 has its emitter connected to the supply terminal 20 and its collector connected to the stabilised positive supply line 24. The base of transistor 27 is also returned to the emitter of the transistor by way of a resistor 28. This arrangement operates in known manner to stabilise the potential of positive supply line 24. A bypass capacitor 24*a* shunts the stabilised positive supply line to earth.

The microwave Gunn diode oscillator 2 is fed from stabilised positive supply line 24 by way of a resistor 29. As described in relation to FIG. 1, this oscillator generates electromagnetic radiation at microwave frequency which is radiated within the protected space and reflected by objects therein to a detector 4.

In the microwave detector 4, microwave signals received by antenna 3 are applied by way of a signal input terminal 30 to a detector diode 31, of which the cathode is earthed and the anode is returned to the stabilised positive supply line 24 by way of a resistor 32. There is thus developed across a capacitor 33, connected in shunt with diode 31, a unidirectional potential varying in magnitude with the amplitude of the received microwave return signal. This unidirectional potential is applied to an amplifier circuit 5, specifically to the gate of a field-effect transistor 34 having its source electrode returned to earth by way of the parallel combination of a capacitor 35 and a resistor 36 and having its drain electrode taken to the slider 37*a* of a potentiometer 37 forming an adjustable load resistance for field-effect transistor 34 and thus permitting adjustment of the amplifier gain. One end of potentiometer 37 is connected to stabilised positive supply line 24 and the other end of the potentiometer is connected by way of the series combination of a capacitor 38 and a resistor 39 to the inverting input of an amplifier 40, this input being also returned to earth by way of a resistor 41. The non-inverting input of amplifier 40 is earthed and a negative feedback resistor 42 is connected from the output to the inverting input of the amplifier 40.

The amplified signal appearing at the output of amplifier 40 is applied by way of a resistor 43 to the non-inverting input of a comparator amplifier 44. The potential appearing across a capacitor 45 is applied by way of a resistor 46 to the inverting input of comparator amplifier 44. When the signal applied to the non-inverting input of the amplifier is of greater magnitude than the potential at its inverting input the output potential of the amplifier is high and a diode 47 connected between the amplifier output and capacitor 45 conducts to charge capacitor 45. This capacitor discharges by way of resistor 46 at a rate which is advantageously 20 mV every 22 milliseconds. This capacitor and resistor constitute the peak store 8 of FIG. 1.

The output of amplifier 44 is also applied to a timer circuit 7 and specifically by way of a resistor 48 to the base of an n.p.n. transistor 49 having its emitter earthed and its collector returned to the positive line 24 by way of a resistor 50. The collector of transistor 49 is also connected to one terminal of a capacitor 51 having its other terminal earthed. When transistor 49 is conductive, capacitor 51 remains uncharged. When, however, the magnitude of a signal peak applied to amplifier 44 is less than that of the preceding peak, the output of amplifier 44 disappears. Transistor 49 is thus turned off and capacitor 51 commences to charge by way of resistor 50, thus applying a rising potential by way of a resistor 52 to the inverting input of an amplifier 53, the non-inverting input of which is returned to the positive line 24 by way of series-connected resistors 54 and 55. It is arranged that the potential at the inverting input of amplifier 53 will rise in some 22 milliseconds to a potential which will result in a signal appearing at the amplifier output. If, before the expiry of this period of 22 ms a further peak signal of magnitude in excess of the value to which the potential on capacitor 45 has fallen, is applied to the input of amplifier 44, then this amplifier will yield an output signal, transistor 49 will be turned on and the timer will thus be re-set without yielding an output signal. This is the normal mode of operation when no intruder is present in the protected space.

It will be understood that the times mentioned in the above description relate to an apparatus intended for operation in a space illuminated by lamps operated from an a.c. supply at the European supply frequency of 50 Hz. For 60 Hz supplies the time interval may be some 18 ms.

If, however, an intruder is present within the protected space, the microwave returns from oscillator 2 will vary with time and the values of successive peaks in the output of amplifier 40 will fluctuate. Thus a second peak output of amplifier 40 may be less than the preceding peak and a timer output signal will then be produced at the output of amplifier 53. This is applied to a voltage divider, comprising series-connected resistors 56 and 57, which is returned to the positive line 24. The signal then appearing at the junction of resistors 56, 57 is applied to the base of a p.n.p. transistor 58, having its emitter connected to the positive line and its collector connected to the earth line by way of the series combination of a resistor 59 and a capacitor 60, into which current pulses representative of the output signals of amplifier 53 are thus fed. Resistor 59 and capacitor 60 constitute integrator 9 of FIG. 1.

The timer output signal is also applied by way of a resistor 80 and a diode 81 to discharge storage capacitor 45, thus preparing the peak level store to respond to a following signal peak.

The integrated signal appearing on capacitor 60 is applied by way of a resistor 61 to the inverting input of a trigger amplifier 62, the non-inverting input of which is returned to the positive line 24 by way of a resistor 63. The output of amplifier 62 is coupled to its non-inverting input by way of a feedback resistor 64 and the signal appearing at the amplifier output is fed by way of a 1-second delay circuit, consisting of series resistors 65, 66 and a shunt capacitor connected to earth from the junction of the two resistors, to the non-inverting input of an amplifier 68 provided with positive feedback by way of a resistor 69. The inverting input of amplifier 68 is returned to positive line 24 by way of a resistor 70. When the potential applied to the non-inverting input of amplifier 68 exceeds the magnitude of the potential applied to its inverting input, a signal which appears at its output is fed back to drive the amplifier fully and the resultant output signal is applied by way of a diode 71 to discharge capacitor 60, thus terminating the alarm condition.

Meanwhile, the output signal of amplifier 62 is applied also over a lead 72 to an alarm amplifier 73, of which the output is applied to energise a relay 74, of which the contacts are employed to energise alarm circuits in any required manner, and to the non-inverting input of an indicator amplifier 75 of which the inverting input is taken by way of a resistor 76 to the unstabilised positive supply. The output of amplifier 75 is applied by way of a resistor 77 to an indicator light formed by a light-emitting diode 78 which is connected to the unstabilised positive line by way of a switch 79.

What is claimed is:

1. An intruder alarm apparatus including a radio-frequency radiation source for irradiating with said radio-frequency radiation a space within which an intruder is to be detected, a radio detector responsive to said radio-frequency radiation returned towards said source from objects within said space or from the boundaries thereof to develop detector signals representative of the amount of said returned radiation, and signal processing circuit means responsive to said detector signals to develop an alarm signal in response to predetermined fluctuations in said amount of said returned radiation, the improvement comprising:

signal peak comparator means in said signal processing circuit means, said signal peak comparator means yielding a resetting signal when the amplitude of a peak in said detector signal is not substantially less than the amplitude of a preceding signal peak;

timer means reset to an initial condition by each said resetting signal and, unless so reset, yielding an alarm control signal at an output thereof at the end of a predetermined time interval, the duration of said time interval being somewhat greater than the periodicity of an alternating current supply used to energize fluorescent tubes lighting said space;

and alarm means predeterminedly responsive to said alarm control signal to yield an intruder alarm signal;

whereby said alarm apparatus is immune to periodically fluctuating return of said radiation from said fluorescent tubes.

2. The invention claimed in claim 1 wherein said signal peak comparator means comprises;

first comparator means (44) having first and second inputs and an output, said first comparator means providing said resetting signal at said output only when the potential applied to said first input exceeds that at said second input;

circuit means (40) applying said detector signal to said first input of said first comparator means;

potential storage means (45), (46) responsive to an applied potential to provide a stored potential which diminishes progressively from said applied potential; and means (47) applying said resetting signal to said potential storage means.

3. The invention claimed in claim 2 wherein said potential storage means comprises a storage capacitor (45), and a resistor (46) coupling said storage capacitor to said second input of said first comparator means (44), and further wherein said means applying said resetting signal to said potential storage means comprises a diode (47) coupling said first camparator output to charge said storage capacitor.

4. The invention claimed in claim 3 wherein said alarm control signal is coupled from said timer output by way of the series combination of a resistor (80) and a diode (81) to discharge said storage capacitor.

5. The invention claimed in claim 1, wherein said timer means comprises a timer capacitor (51), stabilized positive supply means (1), charging means (50) progressively charging said capacitor from said positive supply means to increase the potential thereon, switch means (49) operable by said reset signal to discharge said timer capacitor, and trigger means (53) responsive to the potential on said timer capacitor attaining a predetermined level to yield said alarm control signal, said charging means charging said capacitor to said predetermined level in said predetermined time interval.

6. The invention claimed in claim 5, wherein said timer capacitor has one grounded terminal, said charging means comprises a charging resistor connected between the other terminal of said capacitor and said stabilized positive supply means, and further wherein said switch means comprises a transistor having a grounded emitter, a collector connected to the junction of said charging resistor with said timing capacitor, and a base coupled by way of a further resistor to said first comparator means to receive said resetting signal therefrom.

7. The invention claimed in claim 6 wherein said trigger means comprises a difference amplifier (53) of which the inverting input is coupled by way of a resistor (52) to the junction of said timer capacitor with said charging resistor, the non-inverting input is coupled by way of resistance means (54, 55) to said stabilized positive supply and the output is coupled to said alarm means.

8. The invention claimed in claim 1 wherein said alarm means includes integrator means responsive to predeterminedly repeated application of said alarm control signal thereto to yield an alarm initiating signal.

9. The invention claimed in claim 8, wherein said integrator means includes an integrator capacitor (60), a stabilized positive supply means (1), switch means (58) operable by said alarm control signal to supply a predetermined current pulse from said stabilized positive supply means to said integrator capacitor, trigger means (62) responsive to a predetermined state of charge in said capacitor to yield said alarm initiating signal, discharge means (68) responsive to an applied signal to discharge said capacitor, and signal delay means (65–67) yielding an output signal predeterminedly delayed with respect to an applied signal, said signal delay means applying said alarm initiating signal to said discharge means.

10. The invention claimed in claim 9 wherein said switch means comprises a p-n-p transistor of which the emitter is connected to said stabilized positive supply, the collector is connected to said capacitor and the base is coupled to receive said alarm control signal from said timer.

* * * * *